US005340065A

United States Patent [19]

Thomas

[11] Patent Number: 5,340,065

[45] Date of Patent: Aug. 23, 1994

[54] SUPPORT POST

[76] Inventor: John E. Thomas, 50 Mary Street West, Lindsay, Ontario, Canada, K9V 4S7

[21] Appl. No.: 93,660

[22] Filed: Jul. 20, 1993

[51] Int. Cl.[5] ..... A47G 23/02

[52] U.S. Cl. ..... 248/150; 40/607; 40/610; 248/156; 248/166; 248/508

[58] Field of Search ..... 248/165, 166, 150, 156, 248/440, 508; 40/606, 607, 610

[56] References Cited

U.S. PATENT DOCUMENTS

| | | | |
|---|---|---|---|
| 4,249,715 | 2/1981 | Repp | 40/607 X |
| 4,343,449 | 8/1982 | Osthus | 248/156 |
| 4,441,679 | 4/1984 | Calet | 40/607 X |
| 4,825,575 | 5/1989 | Rethke | 40/610 |
| 4,888,894 | 12/1989 | Brown, Jr. | 40/606 |
| 4,910,901 | 3/1990 | Boyar | 40/606 X |

*Primary Examiner*—Ramon O. Ramirez

[57] ABSTRACT

A support for an outdoor sign has an upright where an upper and lower extent are swingably connected to move between an erect position for use and a collapsed position for storage. A cross-bar is pivotally connected to the upright for movement between a perpendicular relation to the upright, for use and a collapsed position for storage.

15 Claims, 5 Drawing Sheets

Figure 1:
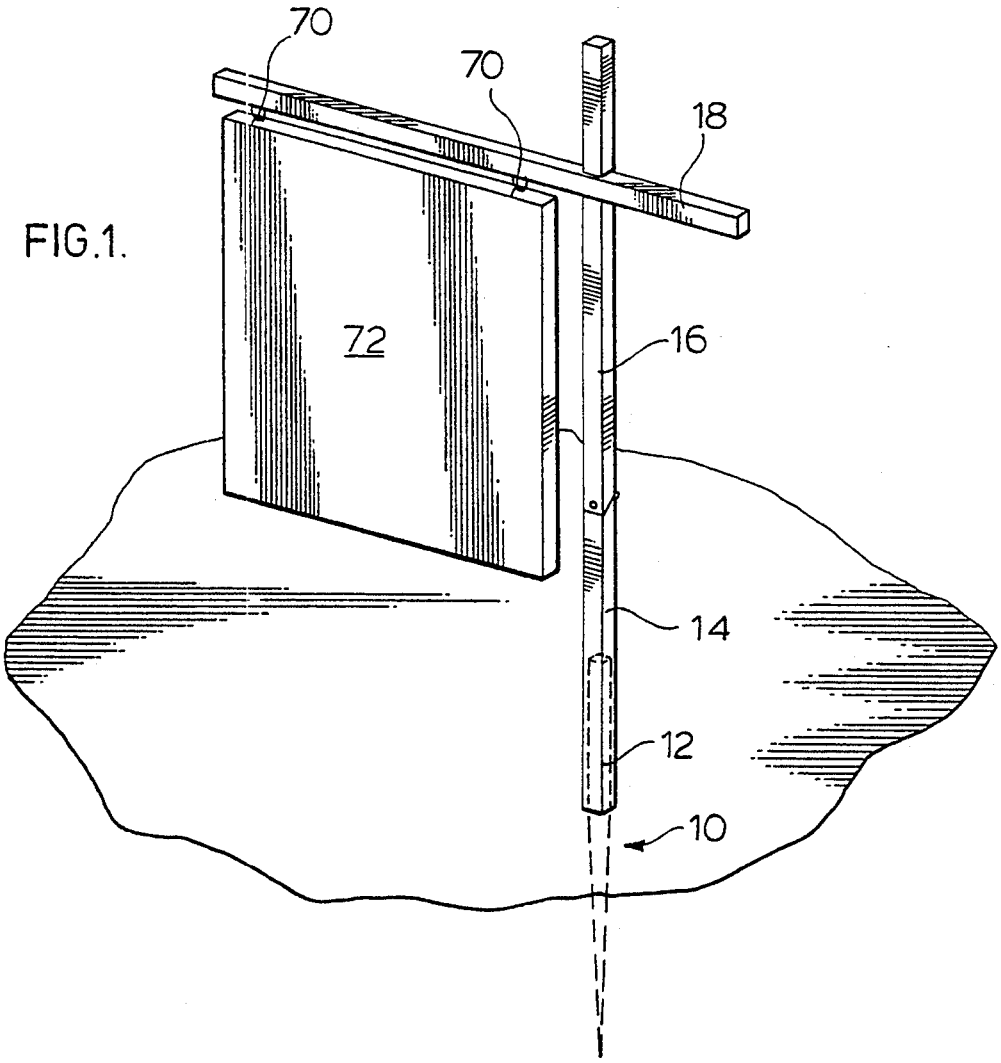

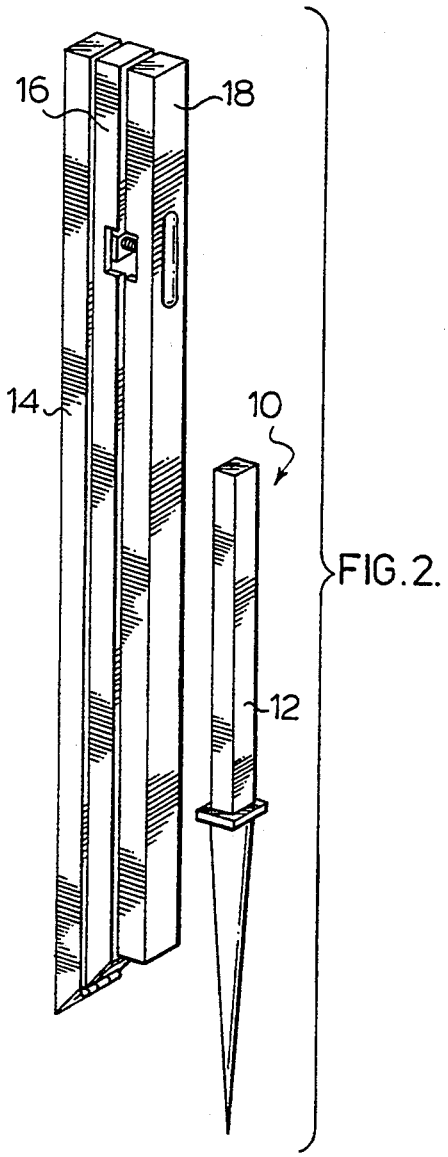
FIG. 2.
FIG. 6.
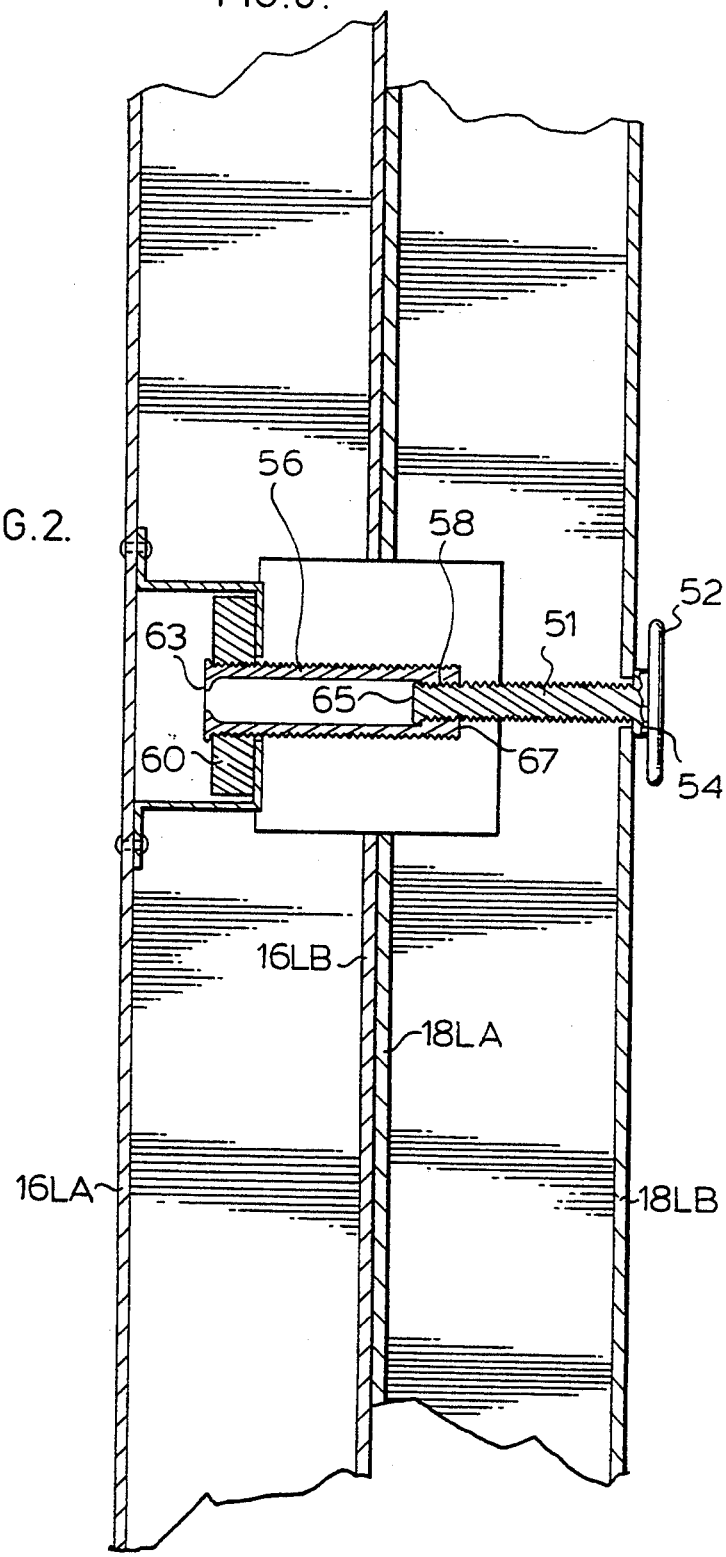

FIG. 5A.
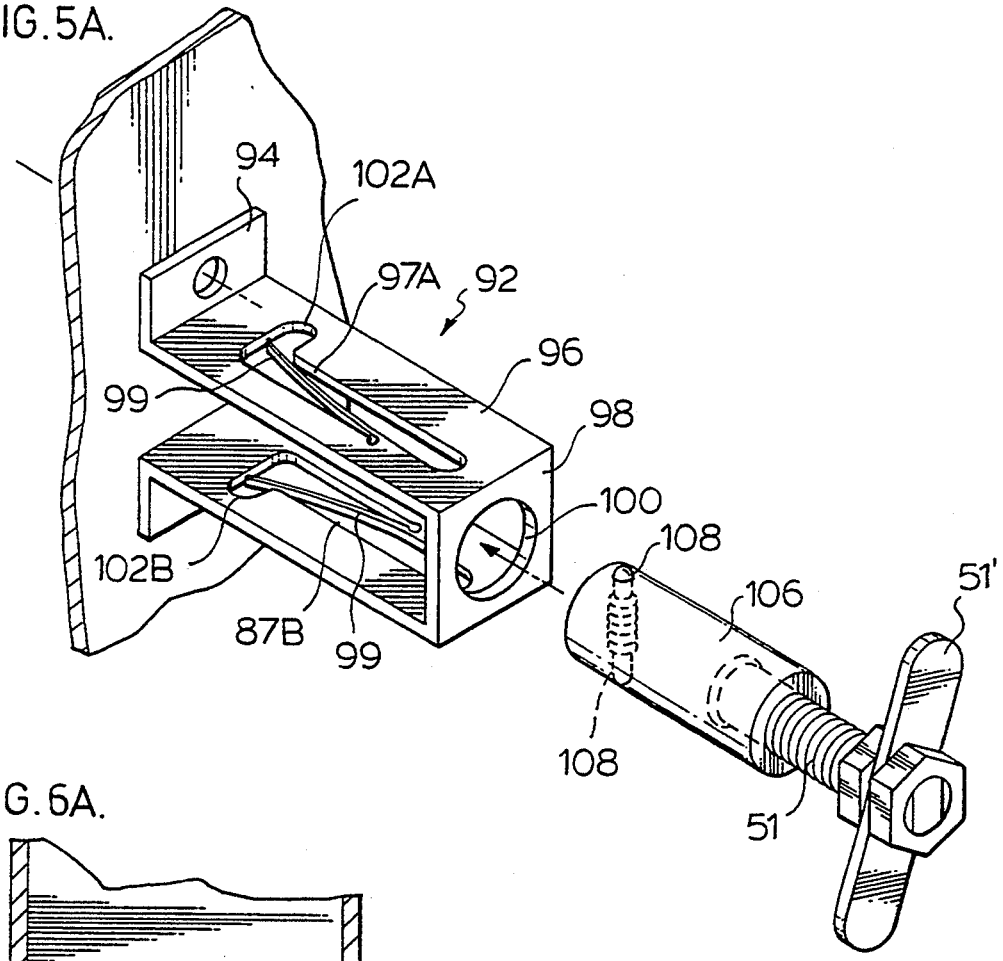
FIG. 6A.
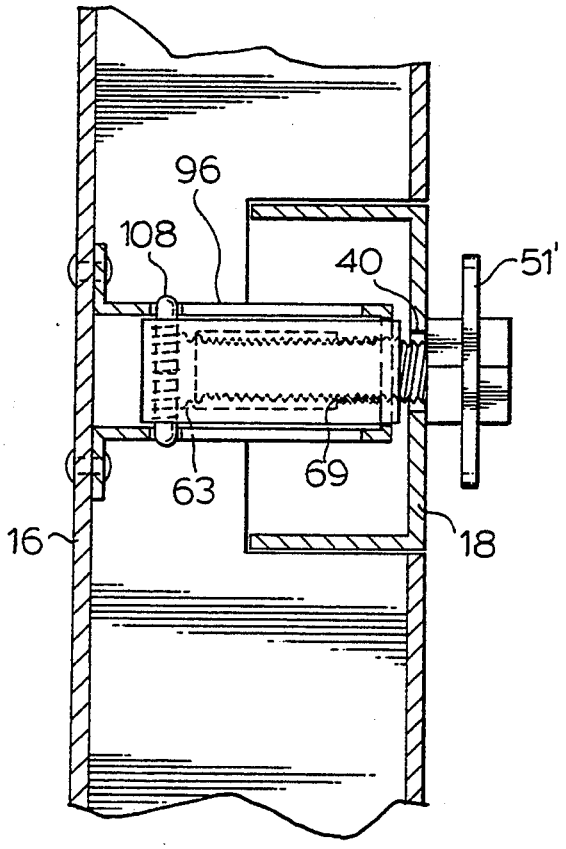
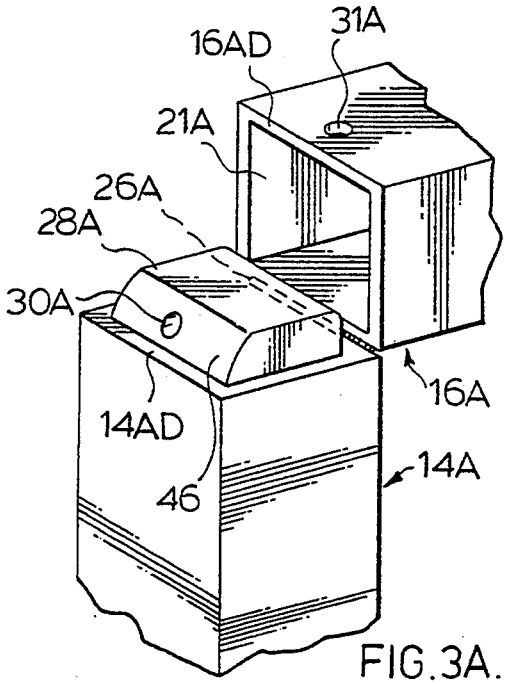
FIG. 3A.

SUPPORT POST

The present invention relates to a support post designed for mounting on a supporting surface and when so supported to, in turn, support a sign.

The support post is particularly suitable for temporary installation on built or building lots which are for use by real estate agents bearing such indicia as "For Sale", "For Rent" or "Open House". However, the invention may be used for many other purposes and signage.

Conventional signs are made of relatively heavy wood or metal, often 5' high with a horizontal arm 3' long and are too heavy for many agents to handle, and too large for easy packing and transportation in an automobile. Moreover conventional signs are composed of too many separate parts and are laborious to erect. For this reason, in many cases the agent does not install his or her own signs but rather the signs must be installed by an independent contractor.

It is an object of this invention to provide a design for a post support which may be made of light materials and which is collapsible into a relatively small bundle for easy transportation in the trunk of an automobile. The collapsed sign is also easily shipped by a courier and is within the permissible parcel size for UPS courier.

It is an object of a preferred embodiment of this invention to provide a design for an upright in accord with the foregoing paragraph when the wherein upper and lower extents forming the upright although manipulable between ERECTED and COLLAPSED position are always connected to reduce the risk of loss of a component.

It is an object of this invention to provide a design for a post support which lends itself to an attractive appearance, so that its appearance is at least as attractive as the heavier, and often more expensive, signs of the prior art.

It is an object of this invention to provide for a post support having an upright which is, on the one hand, light and compact in COLLAPSED position but in the ERECTED position is strong enough for its use in a relatively large and heavy structure.

In accord with the invention separate upper and lower longitudinally extending extents are swingably connected or hinged for movement between an ERECTED position where said extents are longitudinally aligned for use and a COLLAPSED position where the extents are side by side for transportation or storage. A cross-bar is designed, in combination with the upper extent, to be arranged PERPENDICULAR to the upper extent for use or PARALLEL to the upper extent for storage or transportation.

By 'swingable' herein I include pivotal and also more complex rotary motions such as that provided by the articulated linkage described specifically.

In accord with a preferred embodiment of the invention, the cross-bar is pivotally connected to the upper extent, for movement between PERPENDICULAR and PARALLEL attitude.

In preferred arrangements described herein the upper and lower extents may be solid or tubular. If solid then, in the erected position, they meet in the erected position in mutually facing surfaces. If tubular, then in the ERECTED position they meet in the erected position in mutually facing edges. Such mutually facing surfaces or edges will approximately define a plane. Thus, the extension members may be fixed in erected relationship to each other by a bolt generally passing at an angle to the plane and transverse to the pivot axis so that it passes through portions of both the upper and lower extent to fix them in relative position. Preferably the upper and lower members are shaped at their mutually facing portions to provide a plane in the ERECTED position which is up to 65° to the longitudinal direction of the then aligned members. In this way a bolt extending perpendicular to the pivot axis and the longitudinal direction may connect the partially overlapping members.

In a preferred embodiment of the invention, as defined in the last paragraph upper and lower tubular extents have when aligned complementary edges sloping at an angle of up to 65° to the longitudinal direction.

A core in the tubular passage is fixed to one of the extents. The core extends a short distance inside one of the extents and is fixed thereto and projects beyond the extent in which it is mounted sufficiently to rest inside the other extent in ERECTED position but not far enough to inhibit the relative swinging of the upper and lower extents about the swingable connection. Detachable attaching means connect the other extent to the core in the aligned (ERECTED) position of the extents and reenforce the strength of the connection between the members in the ERECTED position. The inventive design for the swingably connected upper and lower extents may be used for many varieties of sign besides those described herein.

The invention also provides, in a preferred aspect, a permanent pivotal connection between the cross-bar and the upright. If the upright has upper and lower extents, the connection is to an upper extent. In U.S. Pat. No. 4,843,746 to Daniel P. DesNoyers, et al, there is shown a support post wherein the cross-bar and the upper extent are provided with mutually facing notches whereby the cross-bar and upper extent may be bolted together in mutually perpendicular relation for use and separated when not in use. However, there is not provided a suitable permanent pivotal attachment between the members.

This invention provides a cross-bar and an upright (preferably its upper extent) which cross-bar and upright are pivotal between a PERPENDICULAR position for use and a PARALLEL position for storage. Since the members may be left permanently connected, no risk of loss of one of them ensues. Such pivotal connections may be by permanently attached bolt. In a preferred aspect of this invention mutually facing recesses in the upright and cross-bar members allow for interlocking in the PERPENDICULAR orientation. Thus the transverse thickness of the upright and cross-bar members is in the PARALLEL position the sum of their transverse thicknesses. However, in the PERPENDICULAR position the total transverse thickness of the members is less than this sum and may be one-half of it. Accordingly this change in the transverse thickness must be provided for by the pivotal connection. Preferably the pivotal connection provides a telescopic bolt having a head end which limits outward transverse movement of one of the members and a nut end which limits outward transverse movement of the other. A telescopic sleeve has inside and outside threading in the same sense so that a head shank may screw in one threading and a nut shank in the other. The maximum transverse spacing (for PARALLEL position) is therefore the non-overlapped length of the nut shank, sleeve, and bolt shank. The minimum transverse spacing (for PERPENDICULAR position) is achieved when there is maximum overlap between the two shanks and the sleeve. In an alternative the sleeve is threaded to one of the bolt or head and is provided with a bayonet connection to the other. With applicant's construction, the arrangement provides for permanent pivotal attachment of the upright and the cross-bar. Moreover, it will be noted that with applicant's arrangement the cross-bar may be clamped to the upper extent in either PERPENDICULAR (for use) or PARALLEL position (for storage).

In a preferred embodiment of the invention as described in the previous paragraph, a bolt shank and sleeve for joining the cross-bar and upright comprises a standard threaded bolt combined with a longitudinally extending sleeve member. The sleeve member has internal threading to receive the bolt threading and external threading to thread into threaded mount on one of the cross-bar or upper extension members farthest from the bolt head. The result is that the spacing of the bolt head from the farthest wall may vary from the position for clamping the upper extension and cross-bar member in PERPENDICULAR attitude to the spacing for clamping in the PARALLEL attitude. This difference in spacing results, assuming both members are the same thickness and notched to the depth of half of this, in a relative change of the bolt length of approximately the thickness of one of the members. Thus the inventive arrangement allows such bolt displacement without having an unsightly bolt end projecting for approximately the thickness of one of the members in the PERPENDICULAR attitude as would be the case if a simple bolt is used.

The rotational connection of the cross-bar and uprights described and claimed herein may be used for many signs other than those described herein.

Figure 3:
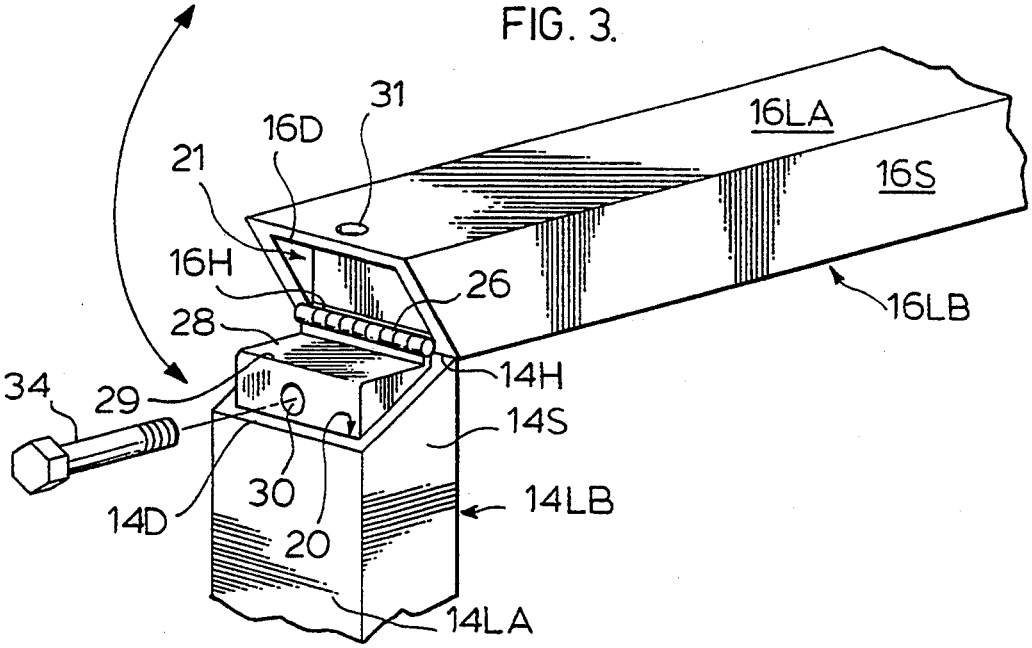
Figure 4:
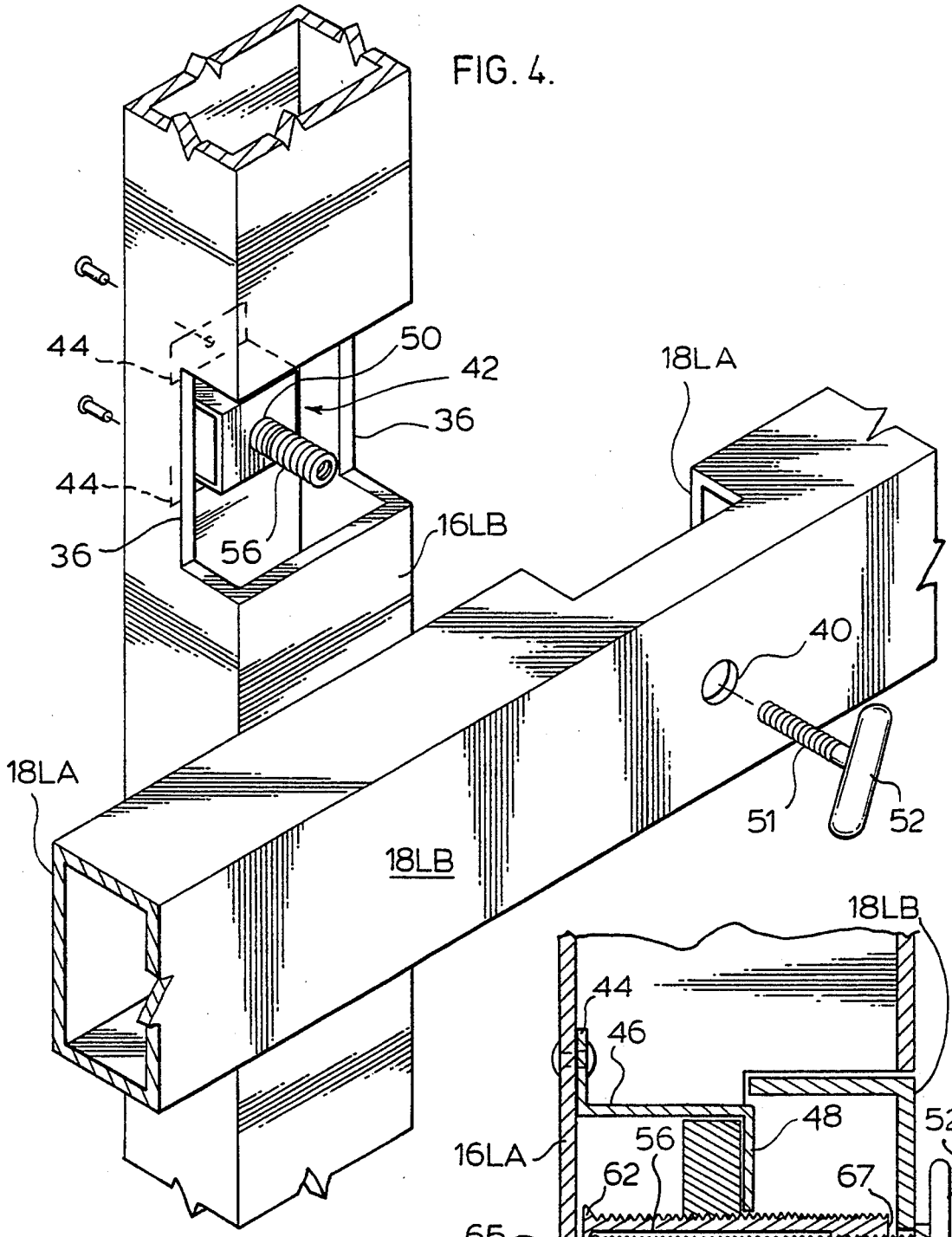
Figure 5:
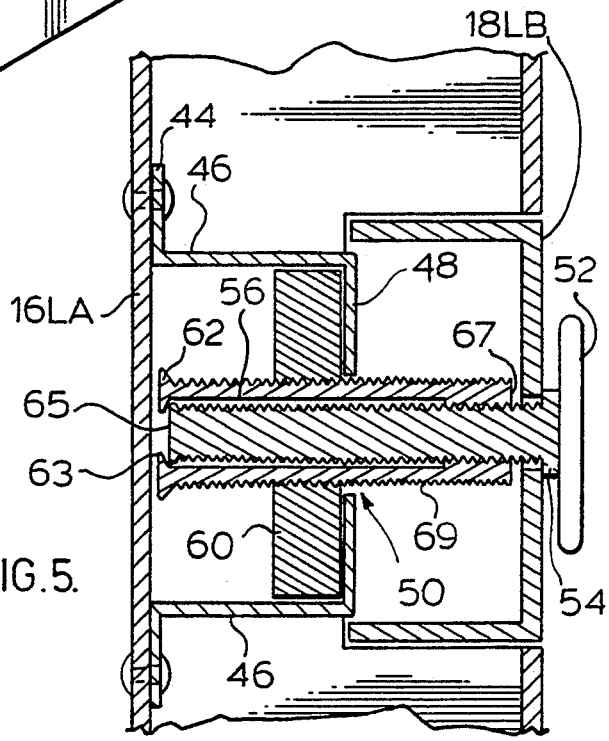

In drawings which illustrate a preferred embodiment of the invention:

FIG. 1 is a perspective of a post support in accord with the invention with upper and lower extents in ERECTED position and the upper extent and cross-bar in PERPENDICULAR position, FIG. 2 is perspective of the post support of FIG. 1 with the upper and lower extents in COLLAPSED position and the upper extent and cross-bar in PARALLEL position, FIG. 3 is a detail of the connection between the upper and lower extents, FIG. 3A is an alternate arrangement, FIG. 4 is an exploded detail of the connection between the upper extent and the cross-bar, FIG. 5 is a section of the connection of the upper extent and the cross-bar taken at right angles to the cross-bar, with the members in PERPENDICULAR relation, FIG. 6 is a section of the connection shown in FIG. 5, and from the same view point with the members in PARALLEL relation, FIGS. 5A and 6A show an alternate connection of the upper extent and the cross-bar, FIGS. 7, 8A, 8B and 8C show a swingable connection between the upper and lower extents which is an alternate to that shown in FIG. 3.

In the drawings, the general arrangement is that a mounting member 10 is insertable in the ground surface defining an upwardly projecting shank 12 preferably of rectilinear section.

The lower extent 14, upper extent 16 and cross-bar 18 are preferably of: (a) tubular construction (b) generally rectilinear section and (c) aluminium.

Parameters (a) (b) and (c) are variable within the scope of the invention.

The members need not be tubular although some preferred aspects of the invention will require this.

A tubular section need not be rectangular. The inventive features may be applied to tubular section which are square, cylindrical or other shape. However, best connection of the upper and lower extents requires a rectilinear (which herein includes 'square') construction. This gives a pleasant appearance and an attractive aspect ratio.

The material may, in place of aluminium, be steel, plastic (if of sufficient strength and thickness) or of wood. Although wood, would not normally be conductive to forming in a tubular shape, it would be suitable where the tubular arrangement was not required.

In accord with the preferred embodiment the lower extent 14 defines a generally rectangular tubular passage 20 and the section of shank 12 is designed to make a close sliding fit therewith.

The lower extent, upper extent and cross-bar are, in the preferred embodiment, of identical section and provided with longer sides and shorter sides using the designation of the member with S and L, respectively, added. The lower extent thus defines shorter sides 14S and longer sides 14L. Each extent defines a longitudinal direction. The upper end of the lower extent is cut at an angle of up to 65° to the longitudinal direction along a plane perpendicular to the shorter sides, so that for angles other than 0° one of the longer sides 14LB is shorter than the other.

The upper extent is, at its lower end, cut in a similar manner, and at an angle to complement that of the lower extent, so that the two members may be placed end to end with their respective edges abutting. The members are pivotally joined by a hinge 26 defining a pivot axis parallel to the plane defined by the complementary edges and parallel to the longer side edges. The hinge 26 has its hinge plates (not shown) connected in any conventional manner to the respective abutting longer sides. It is within the scope of the invention to place the hinge connecting the short sides (so that the bevel and the sloping edges would slope from one short side to the other). However, a stronger hinge may be used and better connection achieved if the hinge connects the longer sides, as shown.

The hinge 26 is shown connecting the higher edge 14H of the lower extent to the higher edge 16H of the upper extent. However, it is within the scope of the invention to have the hinge connect the lower edge 14D of the lower extent to the lower edge 16D of the upper extent.

A core 28, which may be of wood, is designed to be snugly received in the tubular passage of one of the members have passage 20. The core extends from the passage 20 a short distance beyond the sloping edges and out of the passage to be level with the higher of the edges 14H. The core 28 may be firmly affixed to lower extent 14 by any conventional means, not shown. Thus the upper extent 16 may be swung into ERECTED position relation to the lower 14 with its passage 21 snugly fitting over the core. An aperture 31 in the longer wall 16LA of the upper member aligns with a bore 30 in the core. A bolt 34 may therefore be inserted through aperture and into the bore 30 to lock the members in ERECTED position.

I prefer to drill the wall 14LB opposite the bolt so that the bolt 34 may pass through opposed walls 16LA and 15LB and be fastened by a nut on the outside of wall 14LB (not shown).

However, it is within the scope of the invention to provide merely a bore 30 in the core and to provide a threaded plate at the entrance to the bore, to receive the bolt, as is done in furniture manufacture.

The bore and bolt are preferably transverse but may be sloped if desired.

The core may equally be fixed in the upper extent and the lower member bolted thereto.

The location of the hinge axis must be related to the degree of projection of the core, to ensure that there is no interference during pivotal operation of the extents while maintaining a snug fit with the other members when it is attached. As shown I prefer to locate the hinge at the meeting of the upper and lower extent edges and to terminate the projection of the core opposite the hinged edge.

It will be noted that with the single hinge of FIG. 3 the projecting edge 29 of the core, remote from the hinge has a height, relative to the hinge 26 which is limited by the necessity to avoid interference with edge 16D during relative pivotal movement of the members.

The point may be emphasized and an alternate embodiment shown in FIG. 3A which shows tubular lower and upper tubular extents 14A and 16A, respectively. These terminate in edges 14AD and 16AD which are each perpendicular to the longitudinal extents. The core 28A is affixed in any conventional manner to lower extent 14A and projects above edge 14AD and hinge 28A for snug reception in passage 21A. It is noted that for this to occur the core must be chamferred at 46 to allow passage of edge 16AD. Aperature 31A and bore 30A allow use of a bolt to fix the members in erected position.

Figure 7:
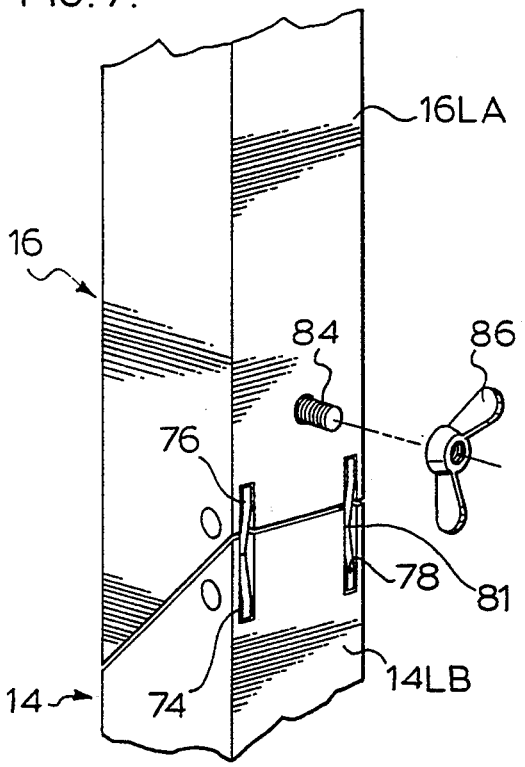
Figure 8C:
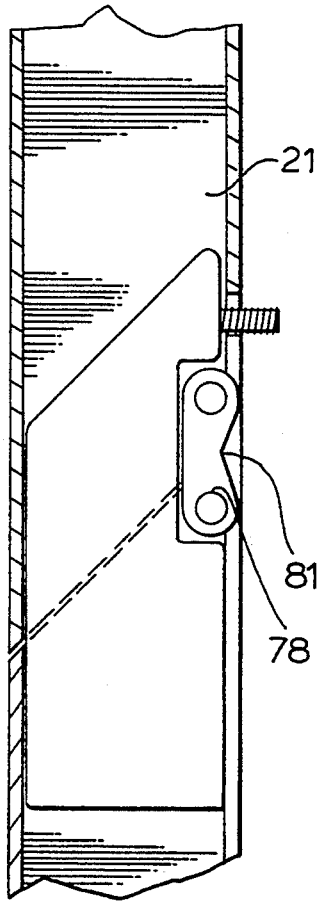
Figure 8B:
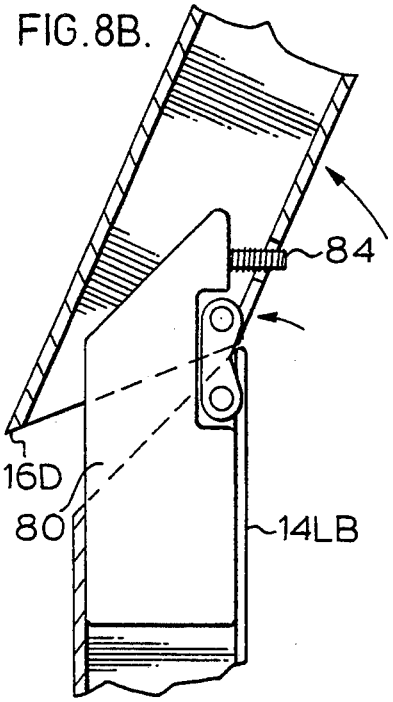
Figure 8A:
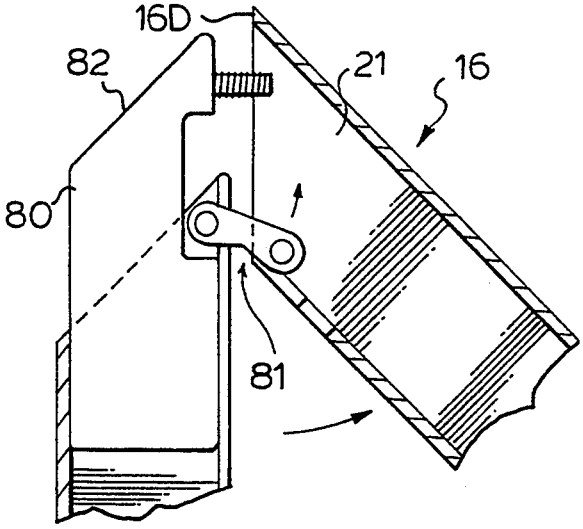

However the question of such interference is avoided and the core may be lengthened, thus strengthening the joint in ERECTED position by replacing the single hinge of FIG. 3 with the articulated links 78 shown in FIGS. 7 and 8. As shown side 14LB is provided with a pair of slots 74 extending parallel to the longitudinal direction of the member. to its upper edge. In the ERECTED position of the member these slots align with slots 76 extending parallel to the longitudinal direction of side 16LB to its lower edge. Each part of aligned slots 74–76 is adapted to receive links 78 which are pivotally connected to these members along axes parallel to the wide dimension of the tubular member. As shown in FIGS. 7 and 8, the links allow the provision of a larger projection of core 80 from its attachment to the lower extent without causing interference with the upper extent as the latter swings into position. The provision of a larger projection together with a snug fit between core 80 and the upper extent 16 provides a more rigid joint in the erected position. As shown the core 80 preferably extends to an end face 82 which is parallel to the angle of the ends of the upper and lower extents. The projecting surface of the core which faces away from the link is provided with a projecting bolt shank 84 fixed thereto. The upper extent, just above its lower edge 16D is provided with an aperture in wall 16LA adapted to receive the bolt shank 84 to project outside the wall in the erected position for application of a nut 86 thereto. Thus, as demonstrated in FIGS. 7–8C the members 14, 16 lie side by side in the COLLAPSED position with core 80 projecting from member 14. When desired for use, extent 16 (FIG. 8A) is swung toward the ERECTED position, the links 78 allow the edge 16D to clear the core, the core to be snugly received in the passage 21 of extent 16 and the aperture to receive the shank 84 when the complementary edges of members 14 and 16 are abutting. A nut may then be tightened on shank 84 holding the members 14–16 firmly in erected position.

(The shallow V cut out 81 in each link 78 allows a perfectly flat fold back of the linked members 14 and 16).

The upper extent near to its upper end is shaped to provide on one of its wide sides 16LB a rectilinear niche having parallel upper and lower edges along the narrow sides spaced as well as on side 16LB to receive a similar perpendicular tubular member therebetween and vertical edges 36 preferably half way between the wider sides. A similar arrangement is provided in a wide side 18LA of the cross-bar 18 so that the two members may be inter fitted in PERPENDICULAR attitude as shown in FIGS. 1, 4 and 5 with the wide sides of the crossed members having common planes due to the preferred interlock depth.

The niche may be more or less than one half the relevant thickness deep but the appearance and or the strength is thought to suffer.

It is within the scope of the invention to provide the niche in each of the cross-bar and upper extent narrower sides. However, the strength of the PERPENDICULAR connection between the cross-bar and the upper extent is believed much greater when the niches are cut in the wide sides of the members.

Returning to the preferred embodiment, the cross-bar wall 16 LB opposite the niche in one of the members is provided with a bolt aperture 40. Opposite the bolt aperture the upper extent is provided with a stirrup 42 comprising a bracket bearing ends 44 connected (by rivetting as shown, or otherwise) to spaced locations on the wall 16LA of the upper extent. Flanges 46 extend outward to support bridging strut 48 therebetween which is provided with an aperture 50 aligned with the aperture 40.

A bolt is provided with shank 51 extending through aperture 40 and has a head 52 attached and keyed to the outer end to allow manual rotation of the bolt. The bolt shank 51 is threaded but clears, loosely the edges of apertures 40 and 50. An enlargement 54 beneath head 52 bears on wall 18LB about aperture 40. A sleeve 56 is provided with internal and external threading, in the same sense. The inner threading is located only at an outer extent 58 of the sleeve inner passage, the rest of the inner passage being of wider diameter than the bolt. The inner threaded passage therefore receives the bolt with the bolt and passage threads meshed. The sleeve when threaded to the bolt extends inwardly loosely through aperture 50 in the threaded plate. A nut 60 is threaded into the inner end of the sleeve and is shaped to key against rotation on the flanges 46 of the stirrup. The inner end of the sleeve is peened outwardly at 62 so that its end cannot be screwed completely through nut 60.

The inner end of the inner passage of the sleeve also has peening 63 extending into the passage to prevent passage therethrough of the inner end 65 of shank 51. The length of shank 51 is chosen relative to that of sleeve 56, so that end 65 will contact peening 63 (on relative inner travel of the shank) before the outer end 67 of sleeve 51 contacts the inner side of wall 18LB (see FIG. 5).

Thus, the bolt shank 51 extends through cross-bar wall 18LB and threads into inside passage of sleeve 56 and the outside threading of sleeve 56 extends through the strut of stirup and is threaded into nut 60. Nut 60 and the stirrup act as the nut shank referred to in the introduction.

The cross-bar 18 is thus permanently attached to the upper extent 16 and the members may be pivotted relative to each other about the bolt axis between PERPENDICULAR (when not interlocked) and PARALLEL positions as hereinafter described.

The stirrup, sleeve 56, bolt shank and head are dimensioned so that with the sleeve's maximum outward excursion relative to the nut 60 and the bolt at its maximum outward excursion relative to the sleeve the members may be arranged side by side in PARALLEL relation, as shown in FIG. 6, occupying twice the thickness, measured along the bolt axis of one of the members 16 or 18. The members may be clamped in their PARALLEL relationship in by tightening the bolt head 52 for transportation or storage.

When it is desired to convert the relationship of members 16 and 18 from PARALLEL to PERPENDICULAR arrangement, the bolt, if clamped, is loosened and the members are relatively rotated to PERPENDICULAR orientation and moved into interlocking relationship as shown in FIG. 5 so that their thickness in the bolt axis direction is that of a single member 16 or 18, as shown in FIG. 5. The bolt is then tightened. It matters not which set of intermeshing threading turns easier. If it is the bolt shank 51 and the sleeve inside thread, then this turning occurs until the shank end 65 contacts the inner sleeve peening 63. The sleeve will then turn in nut 60 until the members are clamped in PERPENDICULAR orientation. The inward bolt movement will equally operate if, initially the shank 51 turns with sleeve 56 and the sleeve rotates in the nut until the sleeve contacts the wall 18LA and the nut contacts the inside of plate 48 and then the bolt turns in the sleeve until clamping in PERPENDICULAR orientation takes place.

To return the PERPENDICULAR members 16 and 18 to PARALLEL position the bolt is rotated in the opening direction. If the bolt initially turns relative to the sleeve then this takes place until the bolt peening contacts shoulder 69 inside the sleeve, after which the sleeve rotates until the sleeve peening 62 contacts the nut 60 and the latter may contact the inner side of the plate 48. The effective bolt and sleeve length is then sufficient to allow separation of the interlocked members to allow their orientation to PARALLEL position and clamping. The device works equally if the sleeve rotates first relative to the nut until the peening 62 stops relative rotation and then the bolt rotates relative to the sleeve.

Cross-bar 18 is provided with rings 70 to allow suspension of a suitable sign therefrom.

In overall operation with the upper and lower extents 14 and 16 in COLLAPSED position and the upper extent 18 in PARALLEL position (FIG. 2) the post support is erected as follows.

The ground support stake 10 is entered into the ground. The lower extent may then be mounted thereon by sliding over the projection 12 of the ground support stake. The upper extent may then be rotated into ERECTED position and fixed in place by placing bolt 34 into the core and tightening to the nut provided. The cross-bar may then be moved into PERPENDICULAR position and clamped as previously described.

It will be appreciated that the three operations:

(a) mounting the lower extent on the stake, (b) moving the lower and upper extents to ERECTED position, (c) rotating and clamping the cross-bar and upper extent in PERPENDICULAR position, may be done in any sequence. Afterward the requisite sign 72 is hung from the cross-bar.

Similarly, the conversion of a sign in use FIG. 1 to the storage version involves first removing the sign 72 from the rings. The three operations:

(d) removing the lower extent from the stake, (e) moving the upper and lower extents to COLLAPSED position, (f) may the upper extent and the cross-bar to PARALLEL position, may be performed in any desired order.

With regard to the embodiment of FIGS. 5 and 6 it is noted that Stirrup 42 side walls (not shown) may provided extending between walls 46 to key to the nut 60 so that the nut is keyed on four sides.

With regard to the embodiment of FIGS. 5 and 6 it is noted that, if desired, the nut 60 may be affixed to, and/or an integral part of the stirrup and as such would be located in the position shown in FIGS. 5 and 6.

FIGS. 5A and 6A show an alternate arrangement to that shown in FIGS. 5 and 6. In FIGS. 5A and 6A, opposite the bolt aperture 40 the upper extent is provided with a stirrup 92 comprising bracket bearing ends 94 connected (by rivetting , or otherwise) to spaced locations on the wall 16LA of the upper extent. Flanges 96 extend outward to support bridging strut 98 extending therebetween which is provided with an aperture 100 aligned with the aperture 40. Flanges 96 are provided with slots 97A, 97B which extends from near the outer to near the inner end. The slots are provided with a right angled turn into an end extent 102A and 102B adjacent their inner end. The direction of the turn is in the sense of a clockwise rotation looking inward along the axis defined by apertures 40 and 100. A leaf spring 99 is associated with each slot, an may be a separate member or part of the flange 96 material and the leaf spring is adapted to bias a stub 108 in slot 97A or 97B into the end extents 102A and 102B.

A bolt is provided with shank 51 extending through aperture 40 and has a head 52 attached and keyed to the outer end to allow manual rotation of the bolt. The bolt shank 51 is threaded but clears loosely the edge of aperture 40. A sleeve 106 is provided with internal threading to mesh with bolt shank 51 threading and the sense of the threading is such that clockwise (inward) rotation of bolt shank 51 carries it into sleeve 106. The sleeve 106 is provided on its outer surface with stubs 108 adapted to ride in slots 97A and 97B. In operation the allowed travel of the shank 51 into the sleeve plus the length of travel of stubs 108 in slots 97A, 97B represents the change in transverse dimension between the PARALLEL and the PERPENDICULAR position.

Accordingly, with the upper extent 18 and cross-bar 18 in the PARALLEL position the bolt head is loosened sufficiently that the members 16, 18 may be rotated to PERPENDICULAR position. The bolt head is then pressed inward causing sleeve 106 to carry stubs 108 to the inner end of slots 97A 97B where leaf springs 99 cause the stubs 108 to move into the right angled extents 102A and B. The bolt head 51' is then tightened relative to sleeve 106 to move cross-bar 18 into fully interlocked position relative to the upper extent 16. The use of the bayonet mounting, stubs 108 and slots 97 represents a considerable time saving in sign assembly over the embodiment of FIGS. 5 and 6.

When it is desired to move the cross-bar and upper extent from PERPENDICULAR to PARALLEL position the bolt head 51 is first rotated counter-clockwise until peened end 65 strikes the sleeve shoulder 69. The sleeve then rotates counter clockwise with the bolt head, carrying stubs 108 out of end extents 102A, 102B against the bias of leaf spring 99 so that the stubs 108 may be moved to the outer ends of slots 97A & 97B. The cross-bar and upper extent members may now be moved completely out of interlocked position so that they may be relatively rotated to PARALLEL position and clamped in this position by a slight tightening of bolt head 51. Once again the use of the bayonet of FIGS. 5A and 6A saves time.

If desired the control 52 or 51' for bolt shank 51 may be welded thereto, or otherwise fastened.

I claim:

1. Support post comprising:

lower extent defining a longitudinal extension direction adapted for mounting on a mounting member with said direction vertical, upper section defining a longitudinal extension direction, means swingably connecting said upper and lower extends allowing swingable movement of said upper section relative to the lower between:

an erected position where said upper section extends from said lower section with its direction aligned with that of said lower section, and a collapsed position where said lower section it beside said upper section, means for releasably fixing said extents in said erected position, a cross-bar defining a longitudinal direction, means pivotally connecting said cross-bar with said upper extent at a location spaced from said swingable connection means, said pivotal connection means allowing rotation of said cross-bar between an orientation perpendicular to said upper extent and an orientation parallel to said upper extent, wherein said upper extent and said cross-bar are shaped to interlock and to key against relative rotation when in said perpendicular orientation.

2. Support post as claimed in claim 1 wherein said lower extent is pivotally connected to said upper extent.

3. Support post as claimed in claim 1 wherein said lower extent is shaped to define an upper end sloping at an angle up to 65° to said lower longitudinal direction and where said upper extent defines a lower end which in the erected position complements said upper end.

4. Support post as claimed in claim 2 wherein said lower extent is shaped to define an upper end sloping at an angle up to 65° to said lower longitudinal direction and where said upper extent defines a lower end which in the erected position complements said upper end.

5. Support post as claimed in claim 1 wherein said upper and lower members are tubular and of generally rectangular section.

6. Support post as claimed in claim 2 wherein said upper and lower members are tubular and of generally rectangular section.

7. Support post as claimed in claim 6 wherein said pivotal connection defines an axis is parallel to the long side of said rectangular section.

8. Support post as claimed in claim 5 wherein each of said upper and lower members defines a central passage, one of said members is fixedly connected to a core member which extends into the relevant passage a short distance at the end adjacent the other member in the erected position, said core member including a portion projecting a short distance beyond said end, said core member and the other member being shaped so that the projecting portion said core member is received in the passage of said other member, and wherein means are provided for detachably attaching said other member to said core for releasably fixing said upper and lower extents in erected position.

9. Support post as claimed in claim 6 wherein each of said upper and lower members defines a central passage, one of said members is fixedly connected to a core member which extends into the relevant passage a short distance at the end adjacent the other member in the erected position, said core member including a portion projecting a short distance beyond said end, said core member and the other member being shaped so that the projecting portion of said core member is received in the passage of said other member, and wherein means are provided for detachably attaching said other member to said core for releasably fixing said upper and lower extents in erected position.

10. Support post as claimed in claim 1 including a rotatable threaded shank extending from one of said upper extent or cross-bar members toward the other, control means mounted on said shank exterior to said one of said members, a sleeve having interior and exterior threading in the same sense, said shank threading being threaded onto one of said exterior and interior said threading, a non-rotating member mounted on said other of said members, being threaded onto the other of said exterior and interior threading; axial travel of said sleeve relative to said shank and said non-rotating member together being as great as the travel transverse to said directions for said cross-bar and said upper extent to move between interlocked perpendicular and parallel position.

11. Support post as claimed in claim 1 including a rotatable threaded shank extending from one of said upper extent or cross-bar members toward the other, control means mounted on said shank exterior to said one of said members, a sleeve having interior and exterior threading in the same sense, said shank threading being threaded onto one of said exterior and interior threading, a non-rotating member mounted on said other of said members, being threaded onto the other of said exterior and interior threading; axial travel of said sleeve relative to said shank and said non-rotating member being as great as the travel transverse to said directions for said cross-bar and said upper extent to move between interlocked perpendicular and parallel position.

12. Support post comprising:

a lower extent defining a longitudinal extension direction, an upper extent defining a longitudinal extension direction, the upper extent defining a longitudinal extension direction, the lower end of said lower extent being swingably connected to the lower end of said upper extent, said extents being adapted to move between an erected position where said extents are aligned and a collapsed position where said extents are side by side, said upper and lower extents being tubular members of generally rectangular section, defining internal passages, a core adapted to be received in each of said passages, said core being affixed to one of said extents and projecting therefrom to be received in the other in ERECTED position, and means adapted to detachably attach said core to the other of said extents in the erected position.

13. Support post as claimed in claim 12 wherein link is pivotally connected to said lower extent and to said upper extent, on pivotal axes which are parallel whereby said link and said axes define the swingable movement of said extents between collapsed and erected position.

14. Support post as claimed in claim 12 wherein the projecting portion of said core fits snugly into said other extent.

15. Support post as claimed in claim 13 wherein the projecting portion of said core fits snugly into said other extent.

* * * * *

UNITED STATES PATENT AND TRADEMARK OFFICE

CERTIFICATE OF CORRECTION

PATENT NO. : 5,340,065

DATED : August 23, 1994

INVENTOR(S) : John E. Thomas

It is certified that error appears in the above-indentified patent and that said Letters Patent is hereby corrected as shown below:

Col. 9,
Claim 1 line 8 change "extends" to -- extents --

Claim 1 line 13 change "it" to -- is --

Col. 10,
Claim 7 line 2 delete "is"

Col. 11,
Claim 12 delete lines 6 and 7, commencing "the upper" and ending "direction"

Col. 11,
Claim 12 line 8 delete "lower" and substitute -- upper --

Claim 12, 3rd last line delete "ERECTED" and substitute -- erected --

Signed and Sealed this

Twenty-third Day of January, 1996

*Attest:*

Bruce Lehman

BRUCE LEHMAN

*Attesting Officer*

*Commissioner of Patents and Trademarks*